US006286718B1

(12) United States Patent
Durrant

(10) Patent No.: US 6,286,718 B1
(45) Date of Patent: Sep. 11, 2001

(54) DISPENSING GUN

(76) Inventor: Ian Alexander Durrant, 55A Harts Grove, Godalming, Surrey (GB), GU8 4RG ( * ) Notice: Subject to any disclaimer, the term of this patent is extended or adjusted under 35 U.S.C. 154(b) by 0 days.

(21) Appl. No.: 09/582,221

(22) PCT Filed: Jan. 20, 1999

(86) PCT No.: PCT/GB99/00185

§ 371 Date: Jul. 20, 2000

§ 102(e) Date: Jul. 20, 2000

(87) PCT Pub. No.: WO99/37407

PCT Pub. Date: Jul. 29, 1999

(30) Foreign Application Priority Data

Jan. 23, 1998 (GB) ..... 9801541
Jul. 6, 1998 (GB) ..... 9814639

(51) Int. Cl.[7] ..... B67D 5/00
(52) U.S. Cl. ..... 222/80
(58) Field of Search ..... 222/80, 63, 327, 222/391

(56) References Cited

U.S. PATENT DOCUMENTS 2,768,768 10/1956 Cornell et al. ..... 222/80
2,895,773 * 7/1959 McConnaughey ..... 222/391
4,335,834 6/1982 Zepkin ..... 222/63

FOREIGN PATENT DOCUMENTS 0 406 113 1/1991 (EP) .
2 172 059 9/1986 (GB) .

* cited by examiner

*Primary Examiner*—Philippe Derakshani
*Assistant Examiner*—Thach H Bui
(74) *Attorney, Agent, or Firm*—Jacobson Holman, PLLC

(57) ABSTRACT

A dispensing gun (2) for us with a cartridge (1), comprising a frame (14) supporting a piston rod (10) and one or more operating levers (16,102) connected to the frame (14) and acting on the piston rod (10), characterised by a reversible ratchet mechanism (26) carried on the piston rod (10) and operated on by one to more operating levers (16,102) for reciprocal motion of the piston rod (10) and a piston (11) for use with a cartridge (1), wherein the piston (11) is attachable to a piston rod (10) in a cartridge (1), the piston comprising a hollow rigid member and a flexible member (12), the flexible member (12) having a periphery which maintains a movable seal with the inside wall of the cartridge, a space being formed between the rigid member and the flexible member allowing movement of the flexible member into the space.

14 Claims, 7 Drawing Sheets

DISPENSING GUN

BACKGROUND OF THE INVENTION

The present invention relates to an improved dispensing gun for use in the building trade.

SUMMARY OF THE INVENTION

Conventionally, in the building trade, the filling of joints between paving slabs, brickwork, floor tiles, wall tiles etc. with cement, plastics, adhesives or fillers etc., has been done manually, and this is a very messy, difficult and time consuming task. Known dispensing guns are generally disposable, and have a fitted nozzle of one size. Such dispensing guns can only inject material and are generally difficult to refill. Known dispensing guns can only be used for the purpose of dispensing.

It is an object of the present invention to overcome the problems of jointing of the past.

It is a second object of the present invention to provide a dispensing gun which enables material to be injected or drawn up, easily.

It is a further object of the present invention to provide a dispensing gun which is reusable, easy to clean and designed to fit refillable and ready-to-use cartridges of varied sizes.

A still further object of the present invention provides a piston to be used inside a cartridge, which has a good seal and eases injection of material.

A yet further object of the present invention provides a dispensing gun which can be used for additional purposes, in particular, with an attachable clamp for compressing objects to be adhesively bonded.

According to one aspect of the present invention there is provided a dispensing gun for use with a cartridge, comprising a frame supporting a piston rod and one or more operating levers connected to the frame and acting on the piston rod, wherein a reversible ratchet mechanism is carried on the piston rod and operated on by one or more operating levers for reciprocal motion of the piston rod, characterised in that the reversible ratchet mechanism comprises a pair of springs separated by a forward washer and a reverse washer, the forward washer having a forward tang extending radially and outwardly therefrom, and the reverse washer having a reverse tang extending radially and outwardly therefrom.

Preferably, one or more operating levers are provided with a forward or reverse portion arranged to impart movement to the respective washer through selectable contact with respective forward and reverse tangs.

Again preferably, the operating lever is pivotally connected to a reversing arm which imparts movement to the washer by means of the reverse tang when the washer is in a reverse position.

The operating levers may be pivotally or slidably connected to the frame and the frame may have a receiving socket which connects to form a seal with an attachment means on the cartridge.

Advantageously, the piston rod is attached to a piston in the cartridge, the piston comprising a hollow rigid member and a flexible member, the flexible member having a periphery which maintains a movable seal with the inside wall of the cartridge, a space being formed between the rigid member and flexible member allowing movement of the flexible member into the space. The periphery of the flexible member may have angled sides forming a movable sealed fit with the inside walls of the cartridge.

Preferably, the cartridge has a nozzle of copper to deformably fit into a dispensing tube, the dispensing tube being removably attached to the cartridge.

A restraining means may be attached to the frame which comprises, a restraining member carried on the piston rod and movable by a displacement means; in a first position the restraining member abuts a fixed abutment means and frictionally engages the rod to prevent movement of the rod in one direction, in a second position the restraining member does not engage the rod.

Preferably, the displacement means comprises a slidable abutment means having a displacing member, the restraining member being moved from the first position to the second position by sliding the slidable abutment means so that the restraining member is displaced by the displacing member.

Again preferably, the restraining member is a washer carried on the piston rod.

A clamping structure may be removably attached to the dispensing gun when the cartridge is removed, the clamping structure having a spine, a fixed plate being fixed on the spine and a slidable plate being slidable along the spine and acted upon by the piston, the arrangement being such that, in use, objects to be adhesively bonded can be fixed between the fixed plate and the slidable plate and held under compression.

According to a further aspect of the present invention there is provided a piston for use with a cartridge, wherein the piston is attachable to a piston rod in a cartridge, the piston comprising a hollow rigid member and a flexible member, the flexible member having a periphery which maintains a movable seal with the inside wall of the cartridge, a space being formed between the rigid member and the flexible member allowing movement of the flexible member into the space.

Preferably, the periphery of the flexible member has angled sides forming a movable sealed fit with the inside walls of the cartridge.

BRIEF DESCRIPTION OF THE DRAWINGS

In order to aid in understanding the invention some specific embodiments thereof will now be described by way of example and with reference to the accompanying drawings, in which.

DETAILS

Figure 1:
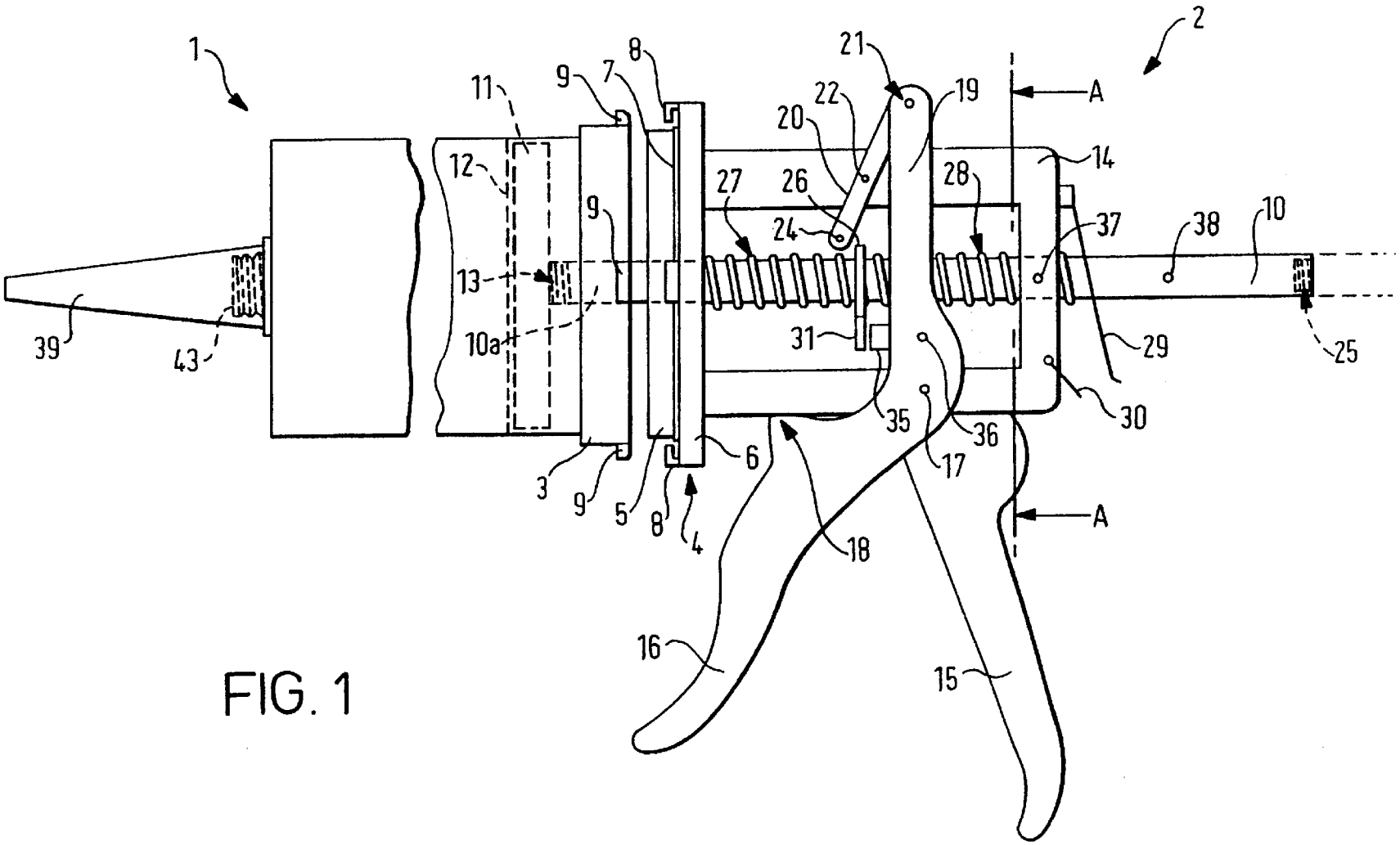
FIG. 1 is a partly sectional side view showing a device according to the invention.

Referring to FIG. 1, there is shown a cartridge 1 attached to a dispensing gun 2 by an attachment means 3 of the cartridge 1 fitting into a receiving socket 4 on the dispensing gun 2. The attachment means 3 fits over a plug 5 and abuts against a stop 6 of the receiving socket 4. A rubber washer 7 creates a sealed unit between the receiving socket 4 and the attachment means 3 which is held in place by clips 8, which lock over abutments 9 positioned around the edge of the attachment means 3. The clips 8 being easily releasable for fast removal and reloading of the cartridge 1 into the dispensing gun 2.

A piston rod or rod 10 runs freely through the receiving socket 4 and at the cartridge end 10*a* of the rod is attached a piston 11. The piston 11 has a flexible member 12 which creates a movable sealed fit with the inside of the cartridge 1. The piston 11 is attached to the rod 10 by a screw fitting means 13, enabling a piston 11 of a different diameter to be attached to the rod to fit a cartridge 1 of a different size. The attachment means 3 may also be attached to cartridges 1 of different diameter, to ensure that any sized cartridge 1 will have a sealed fit with the dispensing gun 2.

The receiving socket 4 forms the lower end of a frame 14 which surrounds the rod 10. Attached to the frame 14 are an upper fixed handle 15 and an operating lever or lower rotatable handle 16. The lower rotatable handle 16 is attached to the frame 14 by means of a pin 17 around which the rotatable handle 16 can rotate. The lower rotatable handle 16 has a stop means 18 which abuts against the frame 14 to restrict movement of the handle beyond a certain position and the rotatable handle 16 can be rotated up towards the fixed handle 15, using the fixed handle 15 for leverage. Extending from the pin 17 of the rotatable handle 16 is an arm 19. The arm 19 is connected to a reversing arm 20 by a pin joint 21. The reversing arm 20 is rotatably fixed to the frame 14 by a second pin 22. At the opposite end of the reversing arm 20 from the pin joint 21 is a reverse portion or first abutment 23 fixedly attached to the reversing arm 20 by a first fixed pin 24. The rod 10 may be made up of several lengths and extended by adding further lengths at screw fittings 25. A safety rubber ball may be screwed to the free end of the rod 10 or the free end of the rod 10 may be angled at substantially 90°, to prevent injury.

Positioned around the rod 10 is a reversing washer 26, on either side of which are forward and reverse springs 27 and 28, respectively. Forward spring 27 loosely surrounds the rod 10 and is positioned between the reversing washer 26 and the stop 6. Reverse spring 28 loosely surrounds the rod 10 and is positioned on the opposite side of the reversing washer 26 and may be contained by closing a restraining mechanism 29 with hook 30.

Figure 2:
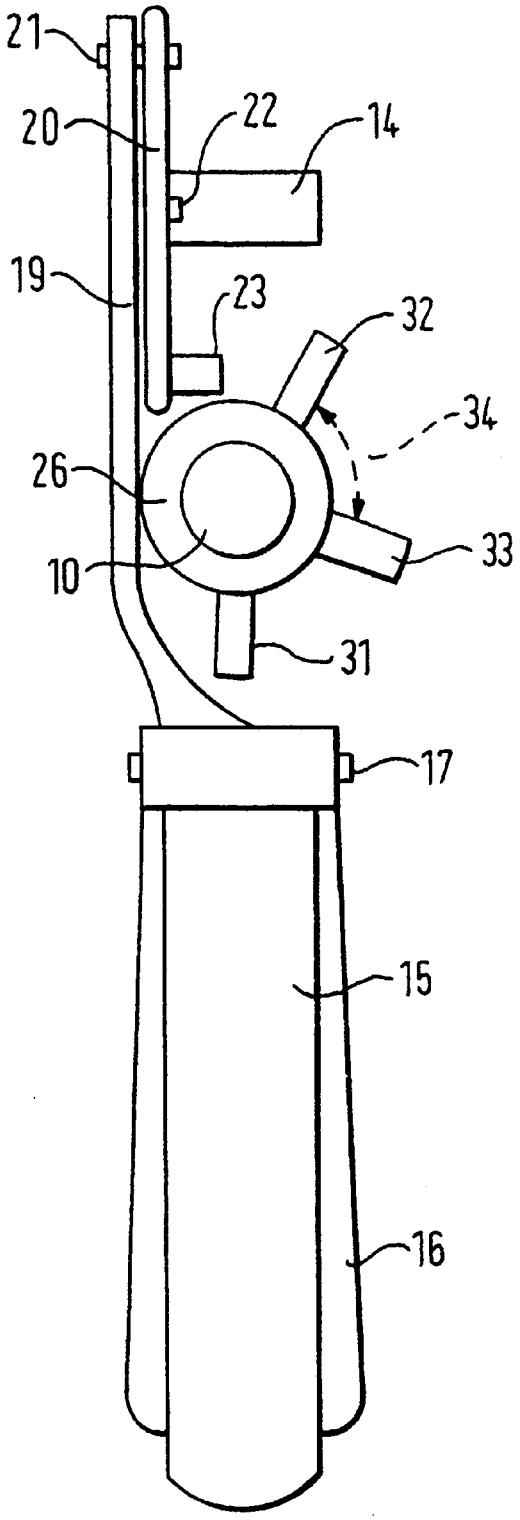
FIG. 2 is a cross-sectional view on line A—A of FIG. 1 showing the reversing mechanism of the device of FIG. 1.

Referring now to FIGS. 1 and 2, the reversing washer 26 has a forward tang 31 and a reverse tang 32, and a handle 33 for rotation of the reversing washer between reverse and forward positions as shown by arrows 34. In the reverse position the first abutment 23 attached to the reversing arm 20 comes into contact with the reverse tang 32 and in the forward position a forward portion or second abutment 35 attached to the arm 19 by a second fixed pin 36 comes into contact with the forward tang 31.

The holes 37 and 38 on the frame 14 and rod 10, respectively, will receive a pin when aligned, to hold the rod 10 in position to enable easy removal and attachment of a cartridge 1 and/or a piston 11.

Figure 4:
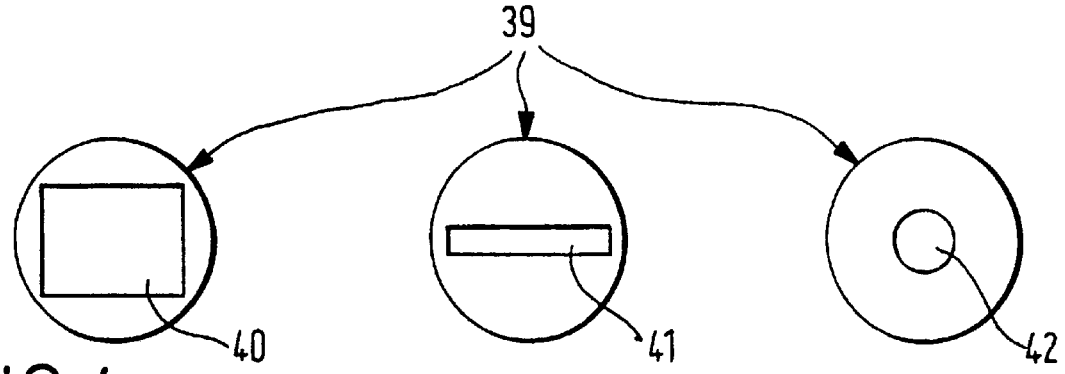
FIG. 4 is a front view of a set of alternative nozzle attachments for use with the device of FIG. 1 or 3.
Figure 5:
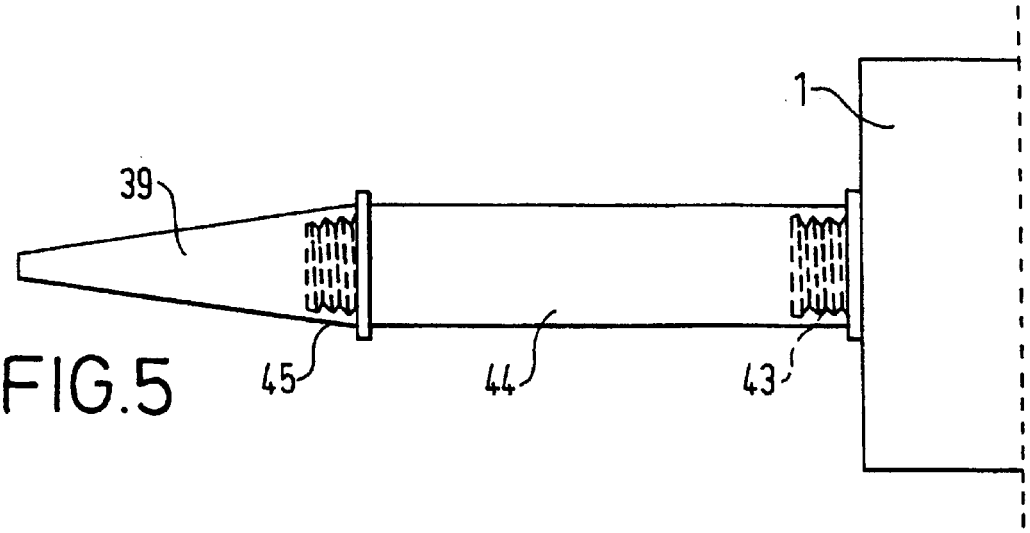
FIG. 5 is a partly sectional side view of a further alternative nozzle attachment for use with the device of FIG. 1 or 3.
Figure 6:
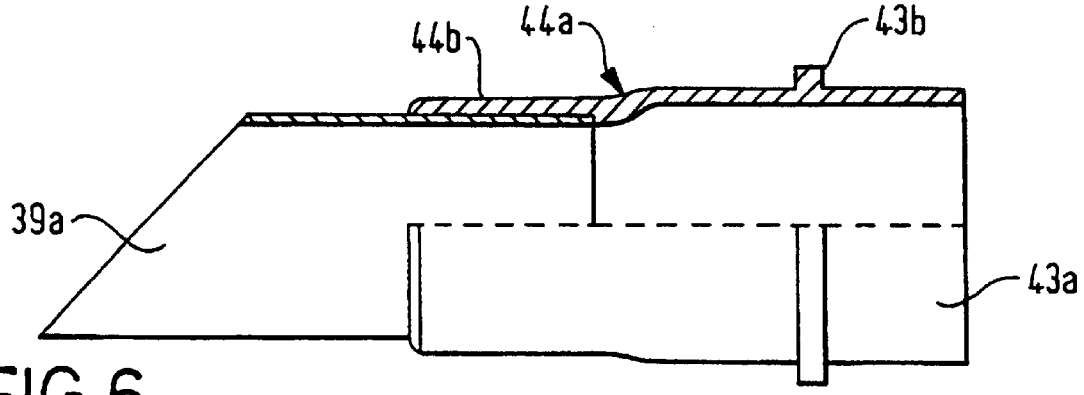
FIG. 6 is a partly sectional side view of a further alternative nozzle attachment for use with the device of FIG. 1 or 3.

Referring now to FIGS. 4 and 5, the cartridge 1 has a nozzle 39 for accurate dispensing of material from the cartridge 1, which is removably attached to cartridge 1 by a thread 43. Different nozzles have different shaped and sized apertures 40, 41 and 42. A flexible tube 44 may also be attached to the cartridge 1 by means of thread 43, the flexible tube 44 can be of selected length to make it easier to access corners or other difficult to reach areas. At the dispensing end of the flexible tube 44 is a second thread 45 for attaching the nozzle 39. FIG. 6 shows a further alternative nozzle arrangement consisting of a dispensing tube 44*a* which may be attached to the cartridge 1 by means of an attachment portion 43*a* forming a close-fit with a co-operating portion on the cartridge 1 (not shown), and having an abutment means 43*b* to indicate when the attachment is completed. The dispensing tube 44*a* has a nozzle insertion end 44*b* of smaller diameter into which a nozzle 39*a*, preferably made of a deformable material, for example copper, is inserted and held in place due to the slight deformation of the nozzle 39*a* on insertion.

In use, a cartridge 1 is filled with material for dispensing and a nozzle 39 is selected according to the width of its aperture 40, 41 and 42. The piston 11 is then inserted into the cartridge, alternatively, if a ready-to-use cartridge 1 is used, then the end of the rod 10*a* can be attached to the already inserted piston 11 by means of the screw fitting means 13. If a different cartridge 1 is to be used, this may require attachment to an attachment means 3 suitable for the diameter of the cartridge 1. The attachment means 3 is then slid over plug 5 until it abuts against stop 6 and forms a seal with rubber washer 7. The clips 8 of the receiving unit 4 are then fastened over abutments 9 on the attachment means 3. The forward position is then selected by rotation of the reversing washer 26 so that the forward tang 31 is aligned with the second abutment 35. The handles 15 and 16 are then squeezed, bringing the lower rotatable handle 16 towards the fixed handle 15. The lower handle 16 rotates around pin 17 causing the second abutment 35, attached to the arm 19 of the lower handle 16 by means of the second fixed pin 36, to depress down onto the forward tang 31. Pressure on the forward tang 31 puts pressure on one side of the reversing washer 26 and causes it to twist. The twisted reversing washer 26 grips the rod 10 and causes the rod 10 to be pulled down with the movement of the second abutment 35. This movement of the rod 10 causes the piston 11 to be pushed down the cartridge 1, therefore, ejecting material contained in the cartridge 1, out of the nozzle 39. The rod 10 is pulled down compressing the forward spring 27 between the reversing washer 26, gripping the rod 10, and the stop 6. When the handle 16 is released, the reversing washer 26, on the rod 10, straightens and no longer grips the rod. The reversing washer 26 is then pushed up the rod 10 by the extension of the compressed forward spring 27. This sequence of movements is then repeated to dispense more material from the cartridge 1 in a ratchet like mechanism.

In reverse, the reversing washer 26 is moved to the reverse position by rotation of handle 33 so that the reverse tang 32 is aligned with the first abutment 23 attached to the reversing arm 20. The restraining mechanism 29 is closed by means of hook 30, enclosing the reverse spring 28 between the reversing washer 26 and the restraining mechanism 29. In the reverse position, the second abutment 35 is no longer positioned in alignment with the forward tang, therefore, when the lower handle 16 is rotated the second abutment can move freely. Rotation of the lower handle 16 therefore, causes the arm 19 to swing around the reversing arm 20, which is fixed by second pin 22 to the frame 14, by means of the pin joint 21. The reverse abutment 23 presses up onto the reverse tang 32, pressure on the reverse tang 32 puts pressure on one side of the reversing washer 26 causing it to twist, therefore gripping the rod 10 and causing the rod 10 to be pulled up with the movement of the abutment 23 against the reverse tang 32. Movement of the rod causes the piston 11 to be pulled up the cartridge 1. The reverse movement can be used to suck up excess material via the nozzle 39, to refill the cartridge 1 or for easy removal of the piston 11 from the cartridge 1, since the piston is tightly sealed against the walls of the cartridge 1 by means of the flexible member 12. This reverse movement pushes the rod 10 up, compressing the reverse spring 28 between the reversing washer 26 and the restraining mechanism 29. When the handle 16 is released, the reversing washer 26, on the rod 10, straightens and no longer grips the rod. The reversing washer 26 is then pushed back down the rod 10 by the extension of the compressed reverse spring 28.

Release of the restraining mechanism 29 enables all the components of dispensing gun 2 to be easily removed for cleaning and replacement.

Figure 3:
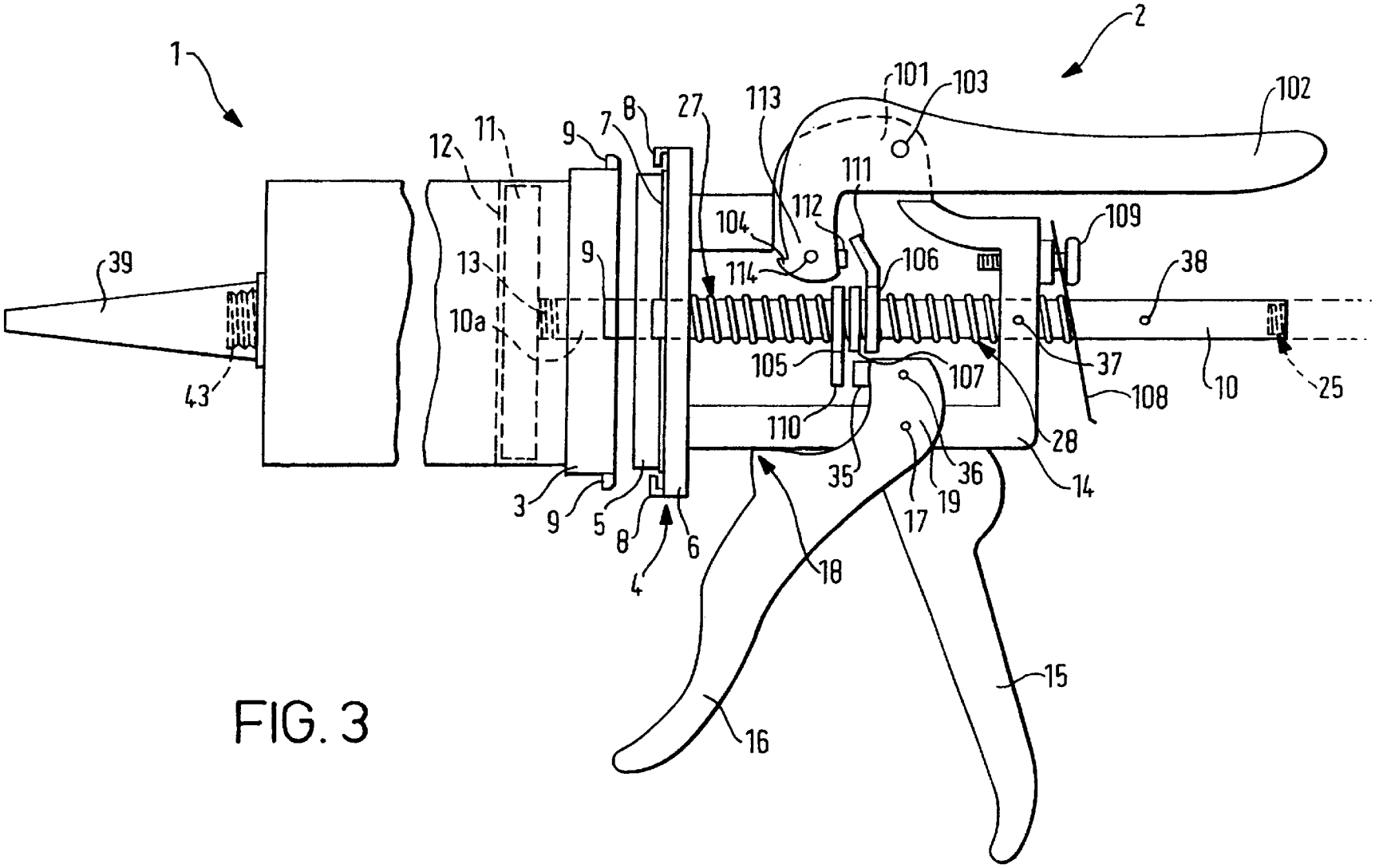
FIG. 3 is a partly sectional side view showing a device according to a further embodiment of the present invention.

Referring to FIG. 3, showing a further aspect of the device of the present invention, in which common elements are indicated with the same reference numerals, there is shown the frame 14 having a base plate 101. Attached to the frame 14 are an upper fixed handle 15 and a forward operating lever or lower rotatable handle 16. The lower rotatable handle 16 is attached to the frame 14 by means of a pin 17 around which the rotatable handle 16 can rotate. The lower rotatable handle 16 has a stop means 18 which abuts against the frame 14 to restrict movement of the handle beyond a certain position and the rotatable handle 16 can be rotated up towards the fixed handle 15, using the fixed handle 15 for leverage. A reverse operating lever or reversing handle 102 is attached to the base plate 101 of the frame 14 by means of a second pin 103 around which the reversing handle 102 can rotate. The reversing handle 102 has a stop means 104 which abuts against the frame 14 to restrict movement of the reversing handle 102 beyond a certain position.

Positioned around the rod 10 is a forward washer 105 and a reversing washer 106, separated by a stop means 107 which is fixed to the base plate 101 of the frame 14. Below the forward washer 105 is a forward spring 27 and above the reverse washer 106 is a reverse spring 28. Forward spring 27 loosely surrounds the rod 10 and is positioned between the forward washer 105 and the stop 6. Reverse spring 28 loosely surrounds the rod 10 and is positioned between the reverse washer 106 and a restraining mechanism 108.

The restraining mechanism 108 is held at one end by a screw 109 and the rod 10 passes through the restraining mechanism 108. Tightening of the screw 109 causes the restraining mechanism 108 to twist and grip the rod 10, therefore preventing movement of the rod 10. Loosening of the screw 109 releases the restraining mechanism 108 which straightens and allows free movement of the piston rod 10.

The forward washer 105 has a forward tang 110 and the reverse washer 106 has a reverse tang 111. The forward tang 110 of the forward washer 105 is positioned in line with a forward abutment 35 which is attached to arm 19 of the rotatable handle 16 by means of a fixed pin 36. The reverse tang 111 of the reverse washer 106 is positioned in line with a reverse abutment 112 which is attached to arm 113 of the reversing handle 102 by means of a second fixed pin 114.

The reversing handle 102 is angled so that each ratchet movement creates a long upwards stroke of the reverse abutment 112, and the reverse tang 111 on the reverse washer 106 is also of longer length and angled to impart maximum movement of the reverse washer 106 up the rod 10 when movement is imparted to it by contact with the reverse abutment 112 caused by rotation of the reversing handle 102. The reverse mode is therefore quicker and easier, requiring fewer ratchet strokes for removal of the piston 11 from the cartridge 1. The reverse spring 28 is longer in length than the forward spring 27, covering a longer length of the rod 10, enabling the longer ratchet strokes of the device in the reverse mode. The forward spring 27 is made of stronger wire than the reverse spring 28, since a stronger force is exerted in the forward mode for dispensing material from the cartridge 1.

The device according to a further aspect of the present invention fulfills the same function as the device of the present invention, and will now be described in use. In the forward mode, the handles 15 and 16 are squeezed, bringing the lower rotatable handle 16 towards the fixed handle 15. The lower handle 16 rotates around pin 17 causing the forward abutment 35, attached to the arm 19 of the lower handle 16 by means of the fixed pin 36, to depress down onto the forward tang 110. Pressure on the forward tang 110 puts pressure on one side of the forward washer 105 and causes it to twist. The twisted forward washer 105 grips the rod 10 and causes the rod 10 to be pulled down with the movement of the forward abutment 35. This movement of the rod 10 causes the piston 11 to be pushed down the cartridge 1, therefore, dispensing material contained in the cartridge 1, out of the nozzle 39. The rod 10 is pulled down compressing the forward spring 27 between the forward washer 105, gripping the rod 10, and the stop 6. When the handle 16 is released, the forward washer 105, on the rod 10, straightens and no longer grips the rod. The forward washer 105 is then pushed up the rod 10 by the extension of the compressed forward spring 27. This sequence of movements is then repeated to dispense more material from the cartridge 1 in a ratchet like mechanism.

In reverse, the reverse handle 102 is pressed downwards causing rotation around the second pin 103. The reverse abutment 112 presses up onto the reverse tang 111, pressure on the reverse tang 111 puts pressure on one side of the reverse washer 106 causing it to twist, therefore gripping the rod 10 and causing the rod 10 to be pulled up with the movement of the reverse abutment 111 against the reverse tang 112. Movement of the rod 10 causes the piston 11 to be pulled up the cartridge 1. The reverse movement can be used to suck up excess material via the nozzle 39, to refill the cartridge 1 or for easy removal of the piston 11 from the cartridge 1, since the piston is tightly sealed against the walls of the cartridge 1 by means of the flexible member 12. This reverse movement pushes the rod 10 up, compressing the reverse spring 28 between the reverse washer 106 and the restraining mechanism 108. When the reverse handle 102 is released, the reverse washer 106, on the rod 10, straightens and no longer grips the rod 10. The reverse washer 106 is then pushed back down the rod 10 by the extension of the compressed reverse spring 28.

Removal of the restraining mechanism 108 by unscrewing the screw 109, enables all the components of the dispensing gun 2 to be easily removed for cleaning and replacement.

Figure 7:
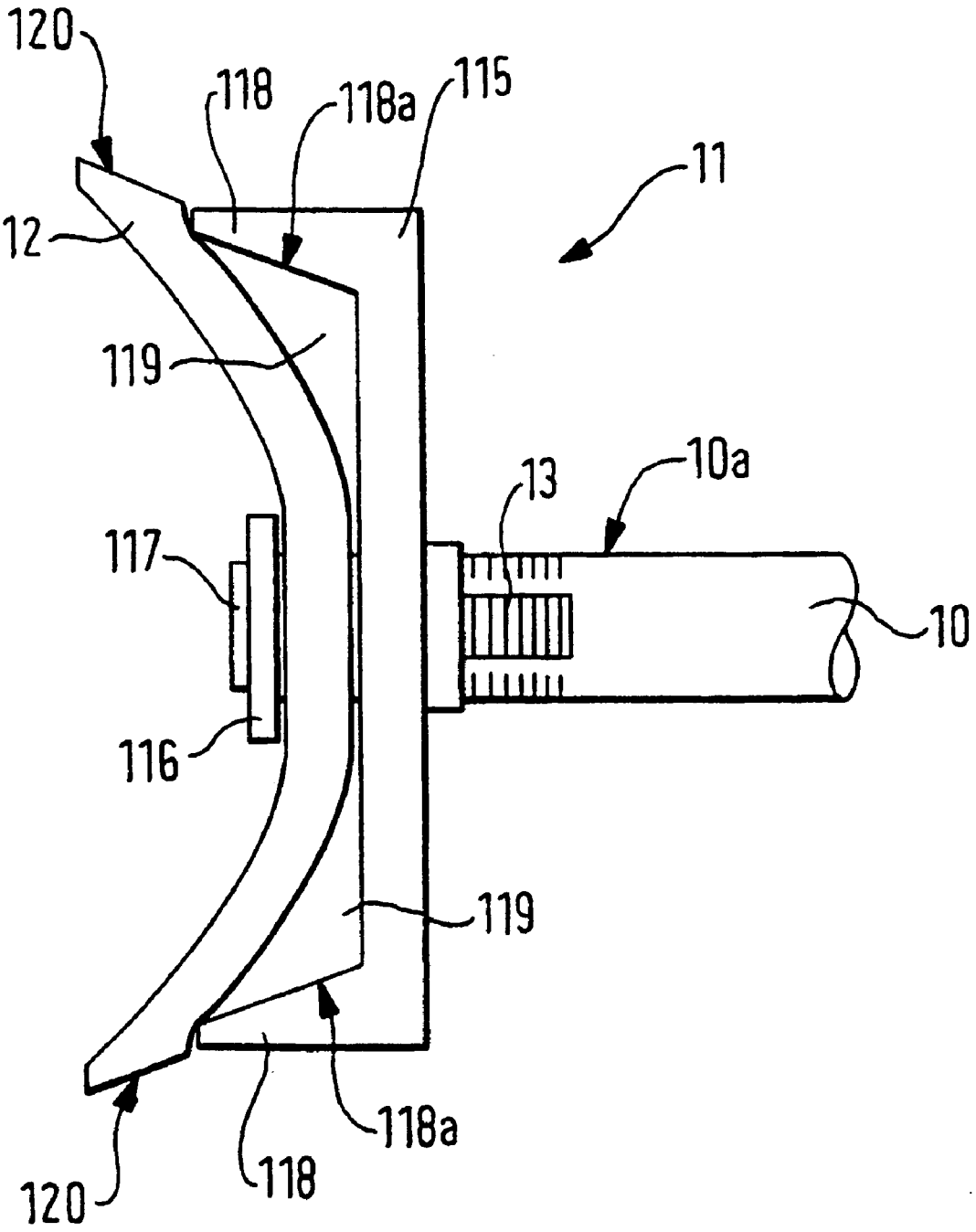
FIG. 7 is a partly sectional side view of a piston for use with the device of FIG. 1 or 3.

Referring to FIG. 7 there is shown a preferred embodiment of a piston 11, in which common elements are indicated with the same reference numerals. A case or rigid member 115 is hollow, shaped to fit the inside of a cartridge (not shown) and has a flexible member 12, preferably made of rubber, which forms a movable sealed fit with the inside wall of the cartridge. The case 115 is attached to the cartridge end 10*a* of the piston rod 10 by a screw fitting means 13. The case 115, the flexible member 12 and a restraining plate 116, which holds the flexible member 12 in position, are held together centrally by a screw means 117. The case 115 is a generally flat member having a depression and a rim 118 with an angled interior side wall 118*a*. The flexible member 12 is concave in shape, the periphery of the flexible member being in contact with the rim 118 of the case 115. A space 119 is formed in the depression of the case 115 between the interior wall 118*a* and the flexible member 12. The flexible member 12 has angled sides 120 which create a movable sealed fit with the inside wall of the cartridge.

In use, movement of the piston 11 down into the cartridge causes the angled sides 120 of the flexible member 12 to flatten against the inside wall of the cartridge maintaining a seal between the flexible member 12 and the inside wall of the cartridge. As the material, for example cement, is pushed down the cartridge by the piston 11, the pressure applied acts via the piston rod 10 on the case 115 of the piston 11. The case 115 applies pressure via the rim 118 to the periphery of the flexible member 12. As the piston 11 is pushed down the cartridge the flexible member 12 is pushed up into the space 119 in the depression of the case 115 by the resistance of the material to be dispensed, this creates a release of pressure around the centre of the flexible member 12. The pressure exerted on the periphery of the flexible member 12 causes the material to be dispensed to be pushed towards the centre of the flexible member 12 into the area of reduced pressure created by the movement of the flexible member 12 into the space 119. Pressure exerted on the periphery of the flexible member 12 is released, reducing the resistance created between the flexible member 12 and the inside wall of the cartridge, while still maintaining a movable seal. Accordingly, less pressure is required to move the piston down the cartridge. Preferably, between each ratchet movement of the device of the present invention the piston 11 is slightly withdrawn up the cartridge, allowing release of the flexible member 12 from the space 119 between the case 115 and the flexible member 12, and also releasing pressure on the material to be dispensed and, therefore, preventing leakage from the nozzle 39 of the cartridge 1 between ratchet movements.

Figure 8:
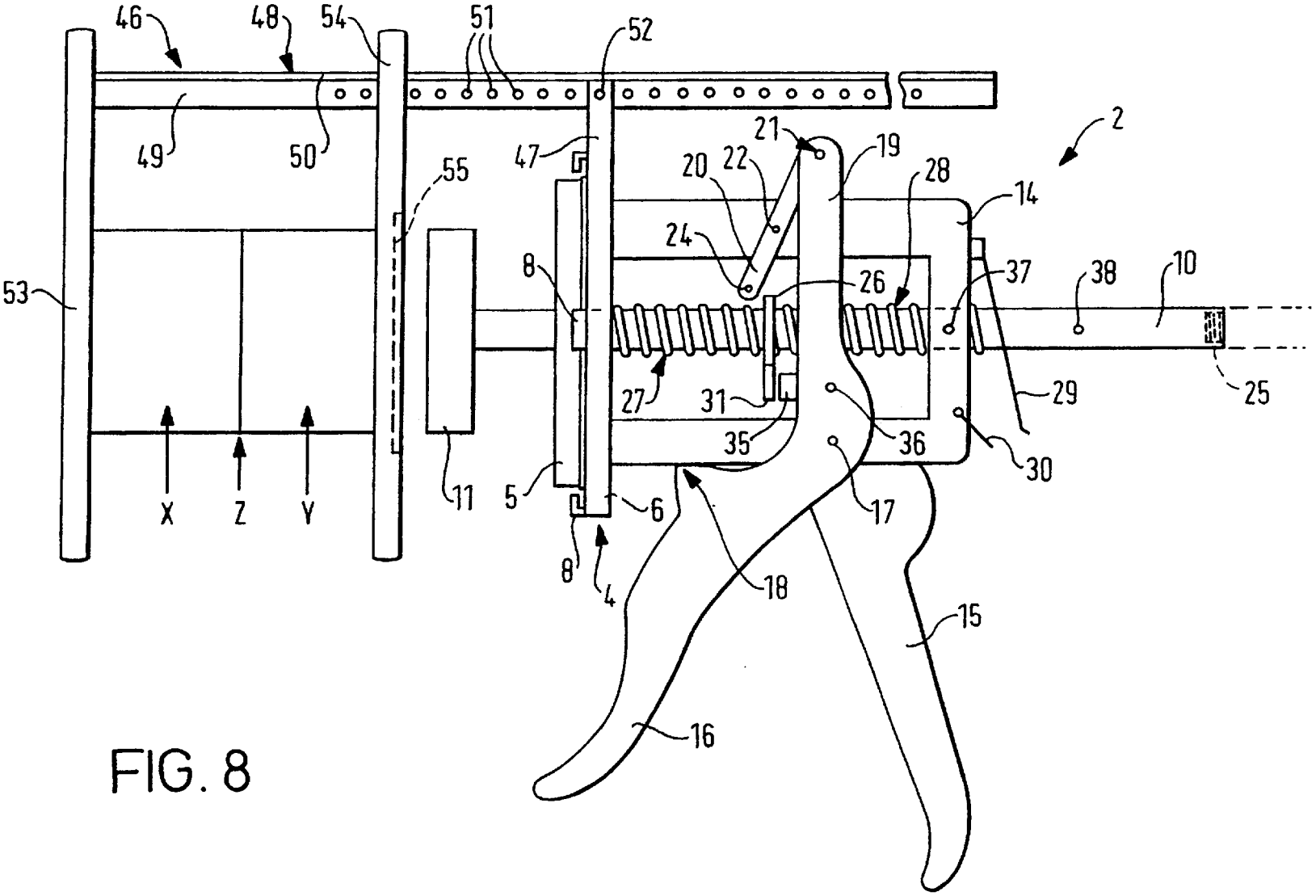
FIG. 8 is a partly sectional side view of a clamp for use with the device of FIG. 1 or 3.

Referring now to FIG. 8 in which common elements are indicated with the same reference numerals, there is shown a clamping structure or clamp 46, attached to the receiving socket 4 of the dispensing gun 2 by means of an attachment bar 47. The attachment bar 47 could also be a permanent extension of the receiving socket 4, or be attached to the frame 14. The clamp 46 has a spine or T-shaped bar 48 with an upright flange 49 and a crossing flange 50. The upright flange 49 has a series of pin apertures 51. The attachment bar 47 is attached to the T-shaped bar 48 by means of a locking pin 52 which passes through a selected pin aperture 51. A fixed plate 53 is attached to one end of the T-shaped bar 48 and a slidable plate 54 is free to slide along the T-shaped bar 48. The slidable plate 54 has a recess 55 for receiving the piston 11 to aid unidirectional compression. A suitable holding clip, not otherwise shown, when in a closed position, holds the slidable plate 54 in position. This allows the clamp 46 to remain in a compressed position, enabling the gun 2 to be removed and used for other purposes. Placed between the fixed plate 53 and the slidable plate 54 are objects X and Y which are adhesively bonded along joint Z. Compression of the objects X and Y by the clamp 46 enables the adhesive to bond tightly in a held position.

In use, for example, the clamp 46 could be used to compress and hold two lengths of timber X and Y together, while being adhesively bonded along joint Z. Several clamps 46 could be used to hold the lengths of timber X and Y together at selected intervals along their length. The timber X and Y is adhesively bonded at joint Z using adhesive dispensed by the dispensing gun 2 and cartridge 1 apparatus, then the cartridge 1 is removed and clamp 46 is attached to the dispensing gun 2. The pin aperture 51 is selected according to the width of timber X and Y to be compressed. The bonded timber X and Y is then fitted into the clamp 46 between the fixed plate 53 and the slidable plate 54. The dispensing gun is operated in a forward direction so that the piston 11 fits into the recess 55 and pushes the slidable plate 54 towards the fixed plate 53, thereby compressing the timber X and Y together. The slidable plate 54 is then locked in the compressed position using the holding clip and the piston 11 can be released by operating the dispensing gun 2 in the reverse direction.

Figure 9:
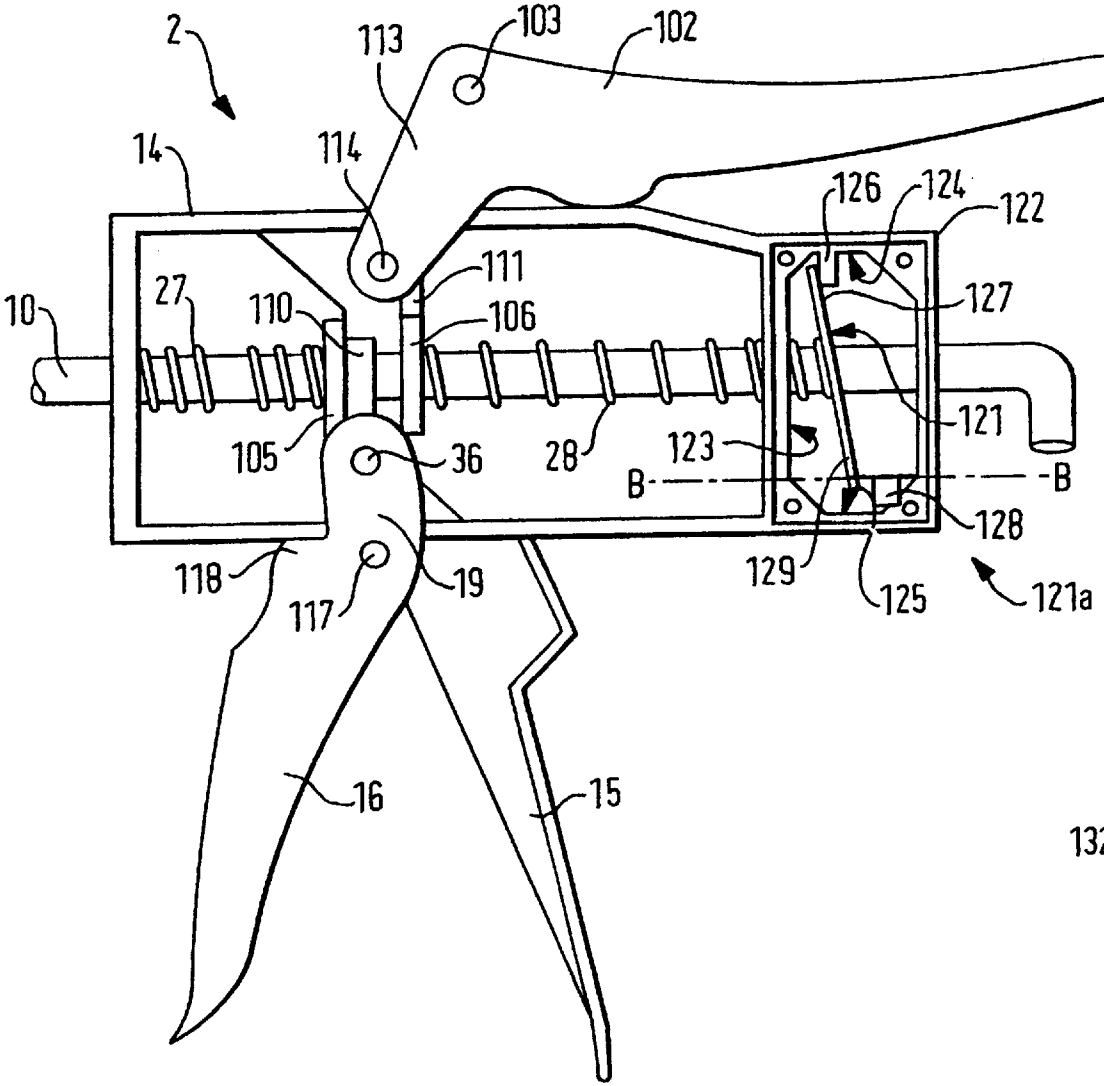
FIG. 9 is a partly sectional side view showing a device of the present invention, having an alternative restraining means.
Figure 10:
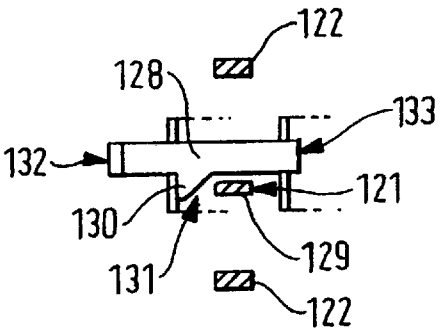
FIG. 10 is a cross-sectional view on line B—B of FIG. 8 showing the restraining means of the device of FIG. 8.

Referring to FIGS. 9 and 10 in which common elements are indicated with the same reference numerals, there is shown a device of the present invention having an alternative restraining means 121*a*. The restraining means 121*a* comprising a restraining member 121 positioned within a housing 122 which is attached to the frame 14 around the free end of the piston rod 10. The housing 122 having a base 123 and first and second sides 124 and 125, respectively. The restraining member 121 surrounds the piston rod 10 and the reverse spring 28 is contained between the reverse washer 106 and the restraining member 121. First side 124 of the housing 122 has a fixed abutment means 126 which cooperates with a first arm 127 of the restraining member 121. Second side 125 of the housing 122 has a slidable abutment means 128 which cooperates with a second arm 129 of the restraining member 121. The slidable abutment means 128 has a displacing member 130 having an angled face 131 and first and second ends 132 and 133, respectively, for displacing the restraining member 121 between a first position and a second position.

In use, the restraining member 121 when in the first position, as shown in FIG. 9, is under pressure from the reverse spring 28 so that the first arm 127 of the restraining member 121 is held against the fixed abutment means 126 and the restraining member 121 twists so that the second arm 129 comes into contact with the slidable abutment means 128. Twisting of the restraining member 121 causes it to frictionally engage and, therefore, grip the rod 10, which prevents movement of the rod 10 in the reverse direction. Movement of the rod 10 in the forward direction releases the restraining member 121 from the fixed and slidable abutment means 126 and 128, respectively, allowing the restraining member 121 to straighten, either naturally or when the restraining member 121 comes in contact with the base 123 of the housing 122, so that the restraining member 121 is substantially perpendicular to the direction of the movement of the rod 10. The rod 10 may then move freely in the forward direction. At the end of a ratchet movement in the forward direction the rod 10 may move in the reverse direction until the restraining member 121 comes in contact with the fixed and slidable abutment means 126 and 128, respectively, causing the restraining member 121 to twist, engage frictionally with the rod 10 and prevent further movement of the rod 10 in the reverse direction. It is particularly advantageous to combine the use of the restraining member 121 with a piston 11 as shown in FIG. 7, since the slight reverse movement of the rod 10 at the end of each forward ratchet movement releases pressure from the flexible member 12 of the piston 11, therefore, releasing the flexible member 12 from the space 119 between the flexible member 12 and the case 115 and preventing leaking of the material to be dispensed from the cartridge 1 between ratchet movements.

The restraining member 121 is displaced to a second position by manually pushing the first end 132 of the slidable abutment means 128, so that the second arm 129 of the restraining member 121 comes into contact with the angled face 131 of the displacing member 130 causing the second arm 129 of the restraining member 121 to be displaced. Displacement of the second arm 129 straightens the restraining member 121, so that it is substantially perpendicular to the direction of the movement of the rod 10, so that the restraining member 121 does not engage with the rod 10 and allows free movement of the rod 10 in both the forward and reverse directions. To displace the restraining member 121 back to the first position, the slidable abutment means 128 is manually pushed from the second end 133 so that the second arm 129 of the restraining member 121 slides back down the angled face 131 of the displacing member 130 and is again in contact with the slidable abutment means 128.

It will also be understood that various alterations and modifications may be made to the above embodiments without departing from the scope of the invention, and that the invention is applicable to other forms of dispensing and for use with many different types of material, for example, for use in piping of icing etc. in the kitchen. For instance, use of a sink plug sized nozzle enables the device to be used as a plunger, for use in unblocking sinks. Also, the attachment means 3 is designed to always form a sealed fit with receiving socket 4, but the attachment means 3 may be varied to fit cartridges 1 of different circumferences. Similarly, the rod 10 has a thread 13 at the cartridge end, enabling the rod to be attached to pistons 11 of different circumferences and for use with ready-to-use cartridges that are available with a piston already attached. Obviously, the nozzle 39 can have apertures 40, 41 and 42 of many different shapes and sizes. Also it is obvious that the restraining member 121 could be displaced by means other than the displacing member 130 of the slidable abutment means 128. It can be foreseen that many different apparatuses could be attached to the dispensing gun of the present invention.

What is claimed is:

1. In a dispensing gun for use with a cartridge, said gun comprising a frame supporting a piston rod and one or more operating levers connected to the frame and acting on the piston rod, wherein a reversible ratchet mechanism is carried on the piston rod and operated on by said one or more operating levers for reciprocal motion of the piston rod, the improvement wherein the reversible ratchet mechanism comprises a washer or washers slidably engaging around said rod and arranged to be engaged and driven respectively by said one or more operating levers in forward and reverse directions relatively to said piston rod and a pair of springs separated by said washer or washers, whereby upon driving engagement of a washer in a forward or reverse direction the washer is twisted to grip and carry the piston rod in said forward or reverse direction, whereas upon release of the washer it is returned along the rod by a corresponding one of said pair of springs.

2. A dispensing gun according to claim 1, wherein one or more operating levers are provided with a forward or reverse portion arranged to impart movement to the respective washers through selectable contact with the forward and reverse tangs.

3. A dispensing gun according to claim 1, wherein the operating lever is pivotally connected to a reversing arm which imparts movement to the reverse washer by means of the reverse tang when the washer is in a reverse position.

4. A dispensing gun according to claim 1, wherein the operating levers are, optionally, pivotally or slidably connected to the frame.

5. A dispensing gun according to claim 1, wherein the frame has a receiving socket which connects to form a seal with an attachment means on the cartridge.

6. A dispensing gun according to claim 1, wherein the piston rod is attached to a piston in the cartridge, the piston comprising a hollow rigid member and a flexible member, the flexible member having a periphery which maintains a movable seal with the inside wall of the cartridge, a space being formed between the rigid member and flexible member allowing movement of the flexible member into the space.

7. A dispensing gun according to claim 6, wherein the periphery of the flexible meter has angled sides forming a movable sealed fit with the inside walls of the cartridge.

8. A dispensing gun according to claim 1, wherein the cartridge has a nozzle of copper to deformably fit into a dispersing tube, the dispensing tube being removably attached to the cartridge.

9. A dispensing gun according to any preceding claim, wherein a restraining means is attached to the frame which comprises, a restraining member carried on the piston rod and movable by a displacement means; in a first position the restraining member abuts a fixed abutment means and frictionally engages the rod to prevent movement of the rod in one direction, in a second position the restraining member does not engage the rod.

10. A dispensing gun according to claim 9, wherein the displacement means comprises a slidable abutment means having a displacing member, the restraining member being moved from the first position to the second position by sliding the slidable abutment means so that the restraining member is displaced by the displacing member.

11. A dispensing gun according to claim 9, wherein the restraining member is a washer carried on the piston rod.

12. A dispensing gun according to claim 1, wherein a clamping structure is remorably attached to the dispensing gun when the cartridge is removed, the clamping structure having a spine, a fixed plate being fixed on the spine and a slidable plate being slidable along the spine and acted upon by the piston, the arrangement being such that, in use, objects to be adhesively bonded can be fixed between the fixed plate and the slidable plate and held under compression.

13. A dispensing gun of claim 1, wherein the reversible ratchet mechanism comprises a single washer having a forward tang extending radially and outwardly therefrom, and a reverse tang extending radially and outwardly therefrom.

14. A dispensing gun of claim 1, wherein the reversible ratchet mechanism comprises a forward washer having a forward tang extending radially and outwardly therefrom and a reverse washer having a reverse tang extending radially and outwardly therefrom.

* * * * *